US008360419B2

(12) United States Patent
Hiura

(10) Patent No.: US 8,360,419 B2
(45) Date of Patent: Jan. 29, 2013

(54) SHEET FEEDING APPARATUS AND IMAGE FORMING APPARATUS

(75) Inventor: Hiroshi Hiura, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/689,509

(22) Filed: Jan. 19, 2010

(65) Prior Publication Data

US 2010/0187750 A1 Jul. 29, 2010

(30) Foreign Application Priority Data

Jan. 29, 2009 (JP) ..... 2009-018819

(51) Int. Cl.
*B65H 1/00* (2006.01)

(52) U.S. Cl. ..... 271/171

(58) Field of Classification Search ..... 271/171
See application file for complete search history.

(56) References Cited

U.S. PATENT DOCUMENTS

| | | | | |
|---|---|---|---|---|
| 4,579,333 | A * | 4/1986 | Aoki | 271/162 |
| 4,697,803 | A * | 10/1987 | Kan et al. | 271/127 |
| 4,874,159 | A * | 10/1989 | Maeno et al. | 271/171 |
| 5,110,106 | A * | 5/1992 | Matsumura et al. | 271/9.06 |
| 5,655,764 | A * | 8/1997 | Ota et al. | 271/171 |
| 5,927,707 | A * | 7/1999 | Miura | 271/171 |
| 6,332,610 | B1 | 12/2001 | Hiura | |
| 6,505,827 | B2 * | 1/2003 | Kawakami et al. | 271/169 |
| 6,883,799 | B2 * | 4/2005 | Matsuki et al. | 271/171 |
| 6,985,265 | B2 * | 1/2006 | Ito | 358/400 |
| 7,198,266 | B2 * | 4/2007 | Takahashi et al. | 271/171 |
| 7,441,769 | B2 * | 10/2008 | Miki | 271/171 |
| 7,516,955 | B2 * | 4/2009 | Yamagishi | 271/171 |
| 7,584,956 | B2 * | 9/2009 | Yamagishi | 271/171 |
| 7,641,188 | B2 | 1/2010 | Hiura et al. | |
| 7,731,181 | B2 * | 6/2010 | Chang | 271/171 |
| 2010/0052247 | A1 * | 3/2010 | Kaseda | 271/226 |
| 2010/0072690 | A1 | 3/2010 | Hiura et al. | |

FOREIGN PATENT DOCUMENTS

| | | |
|---|---|---|
| JP | 2002-321848 | 11/2002 |

* cited by examiner

*Primary Examiner* — Kaitlin Joerger
*Assistant Examiner* — Ernesto Suarez
(74) *Attorney, Agent, or Firm* — Fitzpatrick, Cella, Harper & Scinto

(57) ABSTRACT

A sheet feeding apparatus and an image forming apparatus, including a size detecting portion, which has: a size detecting lever, which is disposed opposite to a side regulation member, and pivots in association with a movement of the side regulation member to a regulation position according to a size of a sheet; and a switch turned ON and OFF according to a pivotal position of the size detecting lever. The side regulation member is provided with a protrusion, which abuts the size detecting lever to amplify a pivotal amount of the size detecting lever pivoting in association with the movement of the side regulation member to the regulation position.

10 Claims, 8 Drawing Sheets

SHEET FEEDING APPARATUS AND IMAGE FORMING APPARATUS

BACKGROUND OF THE INVENTION

1. Field of the Invention

The present invention relates to a sheet feeding apparatus provided with a size detecting portion configured to detect a size of a sheet, and an image forming apparatus including the sheet feeding apparatus.

2. Description of the Related Art

Conventionally, in an image forming apparatus such as a copying machine, a printer, a facsimile, and a multifunction printer having combined functions thereof, a sheet feeding apparatus configured to feed a sheet to an image forming portion is provided. The sheet feeding apparatus is provided with a sheet feeding cassette capable of containing various sizes of sheets. In order to form an image at an appropriate position on the sheet fed from the sheet feeding cassette, the size of the sheet contained in the sheet feeding cassette is required to be discriminated in advance by a control device installed in an apparatus main body of the image forming apparatus.

In this regard, as described in Japanese Patent Application Laid-Open No. 2002-321848, there is proposed an image forming apparatus in which a size detecting portion for transmitting a signal of size information according to the size of a sheet to the control device is provided in order that the control device is capable of discriminating the size of the sheet contained in the sheet feeding cassette. The sheet feeding cassette of this type of the image forming apparatus includes a cassette body and a regulation plate for regulating side edges in the width direction of the sheet. Further, the size detecting portion includes a size detecting lever (cam), which is arranged on an apparatus main body side, and pivots while coming into sliding contact with the regulation plate, and a plurality of detection elements (sensors or switches) selectively turned ON and OFF according to a pivotal position of the size detecting lever.

With this structure, when the regulation plate is moved along the side edge of the sheet contained in the sheet feeding cassette, the size detecting lever pivots in association with the movement of the regulation plate. In this state, when the sheet feeding cassette is mounted in the apparatus main body, according to the pivotal position of the size detecting lever, the size detecting lever selectively turns ON and OFF the plurality of detection elements arranged in the apparatus main body. Then, a signal representing a combination of ON and OFF of the detection elements is sent to the control device. The control device is capable of discriminating the size of the sheet contained in the sheet feeding cassette based on the signal.

Incidentally, the size of the sheet to be contained in the sheet feeding cassette is limited to some extent in the conventional sheet feeding apparatus. Therefore, in recent years, there is a demand for a sheet feeding apparatus adaptable to various sizes of sheets including a small size and a large size.

However, as the size of the sheet contained in the sheet feeding cassette becomes large, a regulation position of the regulation plate gets closer to a pivot supporting point of the size detecting lever, and hence a pivotal amount of the size detecting lever with respect to a moving amount of the regulation plate becomes small. Further, when the difference in size between the various sheets becomes small, the difference in moving amount of the regulation plate becomes small, and hence the pivotal amount of the size detecting lever coming into sliding contact with the regulation plate becomes small.

When the pivotal amount of the size detecting lever thus becomes small, there is fear that ON and OFF of the detection elements are not switched according to the size of the sheet, and hence discrimination of the size of the sheet becomes difficult. That is, there is fear that the control device makes erroneous discrimination of the size without properly detecting the size of the sheet.

Then, when the size of the sheet is erroneously detected, the size of the detected sheet is different from the size of the sheet actually contained in the sheet feeding cassette. Therefore, there is fear that operation of the image forming apparatus becomes unstable as exemplified by occurrence of sheet jamming. Accordingly, there is a need for improving detection accuracy of the size of the sheet.

SUMMARY OF THE INVENTION

The present invention has been made in view of the above-mentioned circumstances, and an object thereof is therefore to provide a sheet feeding apparatus and an image forming apparatus, which are capable of improving the detection accuracy of the size of the sheet.

According to the present invention, there is provided a sheet feeding apparatus, including: a sheet feeding cassette, which is mounted in an apparatus main body, and has a cassette body configured to contain a sheet and a regulation member which is movably disposed in the cassette body and is configured to regulate an edge of the sheet; a sheet feeding portion configured to feed the sheet contained in the cassette body; and a size detecting portion configured to detect a size of the sheet contained in the cassette body, wherein the size detecting portion includes: a size detecting lever, which is disposed opposite to the regulation member, and pivots in association with a movement of the regulation member to a regulation position according to the size of the sheet; and a plurality of detection elements turned ON and OFF according to a pivotal position of the size detecting lever; and the regulation member is provided with an amplification portion which abuts the size detecting lever for amplifying a pivotal amount of the size detecting lever pivoting in association with the movement of the regulation member to the regulation position.

Further, according to the present invention, there is provided a sheet feeding apparatus, including: a sheet feeding cassette, which is mounted in an apparatus main body, and has a cassette body configured to contain a sheet and a regulation member which is movably disposed in the cassette body for regulating an edge of the sheet; a sheet feeding portion configured to feed the sheet contained in the cassette body; and a size detecting portion configured to detect a size of the sheet contained in the cassette body, wherein the size detecting portion includes: a plurality of size detecting levers, which are disposed opposite to the regulation member, and pivot in association with a movement of the regulation member to a regulation position according to the size of the sheet; and a plurality of detection elements turned ON and OFF according to pivotal positions of the plurality of size detecting levers; and the plurality of size detecting levers are formed so that each of the plurality of size detecting levers has a different length from a pivot supporting point to a distal end thereof.

Further, according to the present invention, there is provided an image forming apparatus, including: the above-mentioned sheet feeding apparatus; and an image forming portion configured to form an image on a sheet sent from the sheet feeding apparatus.

Further features of the present invention will become apparent from the following description of exemplary embodiments with reference to the attached drawings.

BRIEF DESCRIPTION OF THE DRAWINGS

FIG. 3A is a perspective view in the vicinity of the size detecting lever 7. FIG. 3B is a perspective view in the vicinity of a proximal end of the size detecting lever 7. FIG. 3C is a plan view in the vicinity of the size detecting lever 7.

FIG. 4A is a perspective view in the vicinity of the size detecting lever 7. FIG. 4B is a perspective view in the vicinity of the proximal end of the size detecting lever 7. FIG. 4C is a plan view in the vicinity of the size detecting lever 7.

FIG. 5A is a perspective view in the vicinity of the size detecting lever 8. FIG. 5B is a perspective view in the vicinity of a proximal end of the size detecting lever 8. FIG. 5C is a bottom view in the vicinity of the size detecting lever 8.

FIG. 6A is a perspective view in the vicinity of the size detecting lever 8. FIG. 6B is a perspective view in the vicinity of the proximal end of the size detecting lever 8. FIG. 6C is a bottom view in the vicinity of the size detecting lever 8.

DESCRIPTION OF THE EMBODIMENTS

Hereinafter, exemplary embodiments for carrying out the present invention will be described in detail with reference to the drawings. Note that, though a description will be below provided of the case where an image forming apparatus is a copying machine, the present invention is not limited thereto. The image forming apparatus may be a printer, a facsimile, or a multifunction printer having combined functions thereof.

Figure 1:
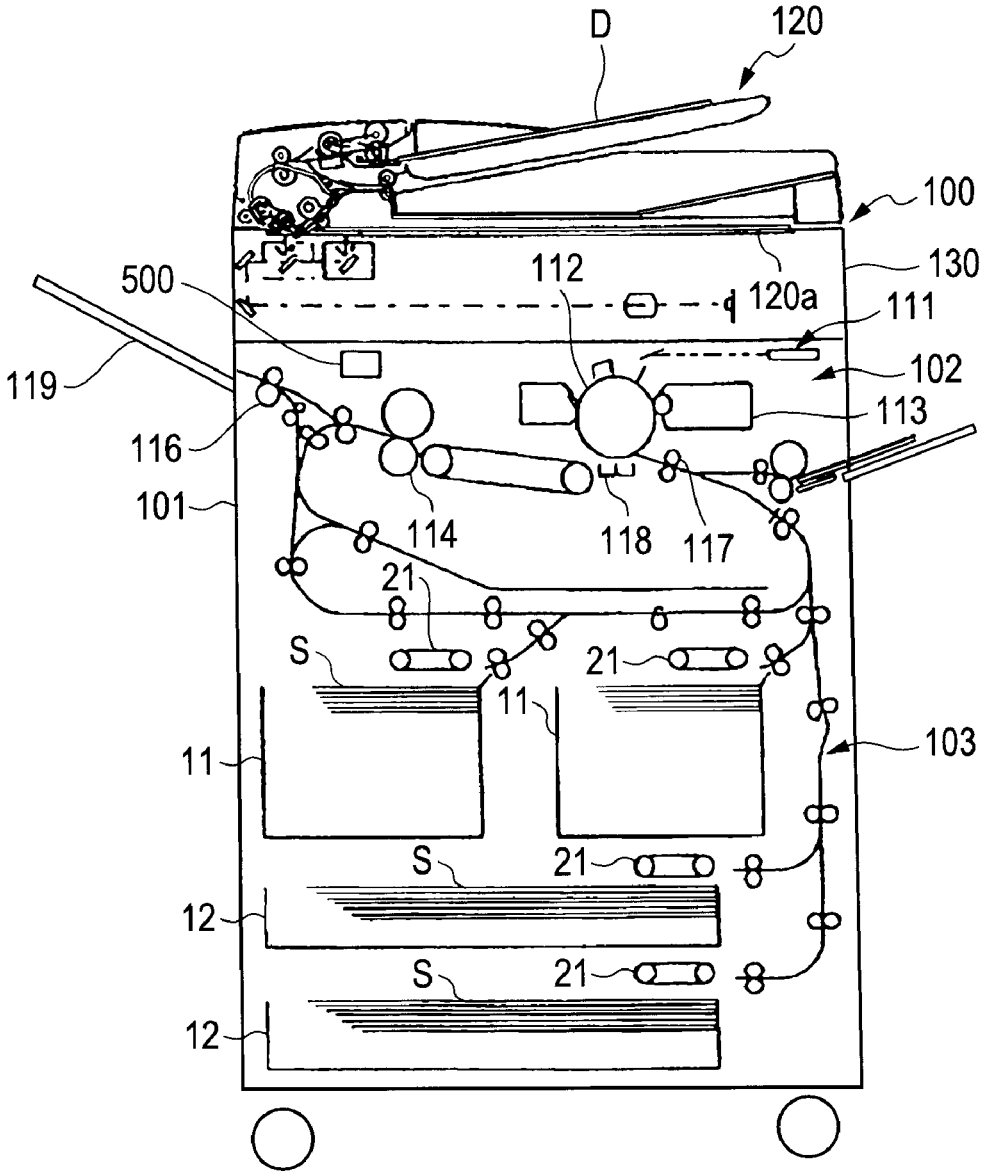
FIG. 1 is a diagram illustrating a schematic construction of a copying machine as an example of an image forming apparatus according to an embodiment of the present invention.

FIG. 1 is a diagram illustrating a schematic construction of a copying machine as an example of the image forming apparatus according to an embodiment of the present invention.

In FIG. 1, in an upper part of a copying machine main body 101, which is an apparatus main body of a copying machine 100 serving as the image forming apparatus, an image reading portion 130 for reading an original D placed on a platen glass 120*a* serving as an original placement stand by an auto original feeder 120. Further, below the image reading portion 130, there are provided an image forming portion 102 and a sheet feeding apparatus 103 configured to feed a sheet S to the image forming portion 102.

In this case, the image forming portion 102 is provided with a photosensitive drum 112, a developing unit 113, and a laser scanner unit 111. Further, the sheet feeding apparatus 103 includes sheet feeding cassettes 11 and 12, which contain the sheets S of various sizes, and are detachably mounted in the copying machine main body 101. Further, the sheet feeding apparatus 103 includes suction conveyer belts 21 which are conveyer belts serving as sheet feeding portions for sending the sheets S contained in the sheet feeding cassettes 11 and 12. This structure for sucking and sending the sheet, which includes a suction conveyer belt 21, is unitized.

Next, a description will be provided of image forming operation of the copying machine 100 having the above-mentioned structure.

When an image reading signal is output from a control device 500 provided in the copying apparatus main body 101 to the image reading portion 130, an image is read out by the image reading portion 130. After that, the photosensitive drum 112 is irradiated with a laser beam which is emitted from the laser scanner unit 111 in accordance with the electrical signal.

The photosensitive drum 112 has been charged by this time. When the photosensitive drum 112 is irradiated with light, an electrostatic latent image is formed. Then, when the electrostatic latent image is developed by the developing unit 113, a toner image is formed on the photosensitive drum.

On the other hand, when a sheet feeding signal is output from the control device 500 to the sheet feeding apparatus 103, the sheet S is fed from the sheet feeding cassette 11 or 12. After that, the fed sheet S is synchronized with the toner image on the photosensitive drum by registration rollers 117, and is sent to a transferring portion defined by the photosensitive drum 112 and a transferring charger 118.

Next, the sheet thus sent to the transferring portion is subjected to transferring of the toner image, and then conveyed to a fixing portion 114. After that, the sheet S is heated and pressed by the fixing portion 114. As a result, a transferred image which has not been fixed is fixed onto the sheet S. Then, the sheet onto which the image is thus fixed is delivered by delivering rollers 116 from the copying machine main body 101 onto the sheet delivering tray 119.

Figure 2:
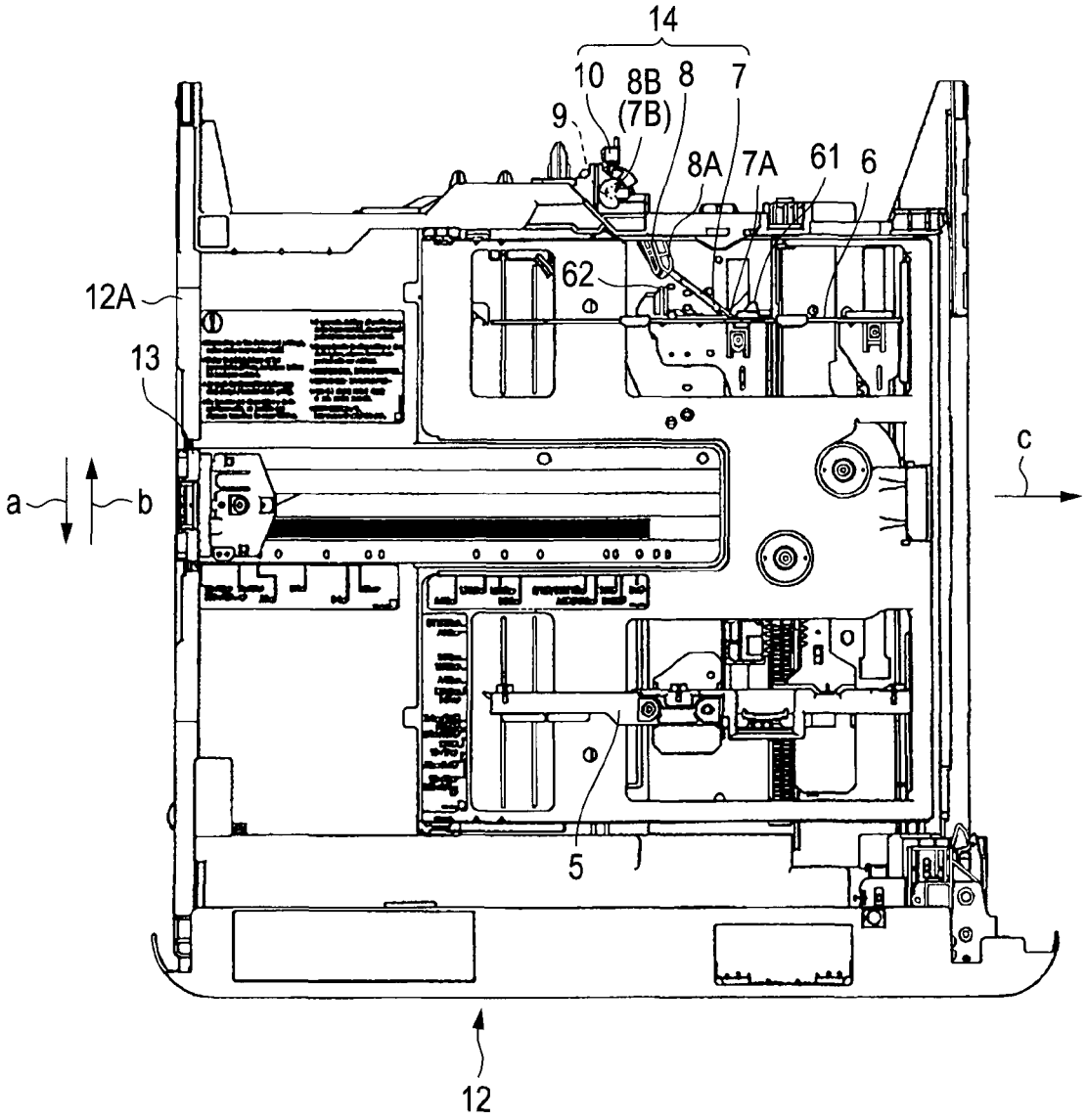
FIG. 2 is a plan view of a sheet feeding cassette of a sheet feeding apparatus.

Next, the sheet feeding apparatus 103 will be described. FIG. 2 is a plan view of the sheet feeding cassette 12 of the sheet feeding apparatus 103. Note that, because the sheet feeding cassettes 11 have substantially the same structure as that of the sheet feeding cassettes 12, a detailed description will be below provided only of the sheet feeding cassette 12.

The sheet feeding cassette 12 is mounted in the copying machine main body 101 so as to be pulled out in the direction orthogonal to a sheet feeding direction. Note that, in FIG. 2, the arrow "a" indicates the direction in which the sheet feeding cassette 12 is pulled out from the copying machine main body 101, and the arrow "b" indicates the direction in which the sheet feeding cassette 12 is mounted in the copying machine main body 101. Further, the arrow "c" indicates the sheet feeding direction in which the sheet contained in the sheet feeding cassette 12 is fed.

The sheet feeding cassette 12 has a trough-shaped cassette body 12A opening upward. The sheet feeding cassette 12 has regulation plates 5 and 6 (hereinafter, referred to as side regulation plates) serving as a pair of regulation members disposed in the cassette body for regulating the positions of side edges of the sheet in the width direction orthogonal to the sheet feeding direction. Further, the sheet feeding cassette 12 has a regulation plate 13 (hereinafter, referred to as a trailing edge regulation plate) serving as a regulation member for regulating the position of the trailing edge of the sheet as the upstream end in the sheet feeding direction.

The side regulation plates 5 and 6 are disposed in the cassette body 12A so as to be movable in the width direction correspondingly to the positions of the side edges of the sheet. The trailing edge regulation plate 13 is disposed in the cassette body 12A so as to be movable in the sheet feeding direction in accordance with the position of the trailing edge of the sheet. The side regulation plates 5 and 6 are movable by a rack and pinion mechanism (not shown) by the same moving amount in the width direction so as to be separated away and come close to each other.

The sheet feeding apparatus 103 is provided with a size detecting portion 14 configured to detect the size of the sheet contained in the cassette body 12A.

The size detecting portion 14 includes a plurality of (two in this embodiment) size detecting levers 7 and 8 and a switch unit 10 having button switches as a plurality of (four in this embodiment) detecting elements.

The size detecting levers 7 and 8 are supported by a pivot shaft 9 so that proximal ends 7B and 8B are pivotable about the pivot shaft 9 as a pivot supporting point provided in the cassette body 12A. Further, the size detecting levers 7 and 8 are opposed to the side regulation plate 6 on the inner part side of the pair of side regulation plates 5 and 6. The size detecting levers 7 and 8 are disposed on the side opposite to the side on which the sheet of the cassette body 12A is contained, with respect to the side regulation plate 6. Further, the size detecting levers 7 and 8 are disposed so that the distal ends 7A and 8A face the side regulation plate 6, and inclined with respect to the plate surface of the side regulation plate 6. The size detecting levers 7 and 8 are biased by a biasing member (not shown, such as a spring) in the direction of abutting the side regulation plate 6. Then, the size detecting levers 7 and 8 pivot against the biasing force of the biasing member (not shown) by being pressed by the side regulation plate 6 in association with the movement of the side regulation plate 6 to the regulation position according to the size of the sheet.

The switch unit 10 is a so-called multiple-series switch in which a plurality of button switches are arrayed in a row. In this embodiment, a four-series switch having four button switches is used. The switch unit 10 is provided so as to be opposed to the proximal ends 7B and 8B in the copying machine main body 101 so that, when the sheet feeding cassette 12 is mounted in the copying machine main body 101 (FIG. 1), the button switches are turned ON and OFF by the proximal ends 7B and 8B of the size detecting levers 7 and 8. Note that FIG. 2 illustrates the state in which the sheet feeding cassette 12 is mounted in the copying machine main body 101, and the proximal ends 7B and 8B of the size detecting levers 7 and 8 turn each of the button switches of the switch unit 100N and OFF. That is, in the proximal ends 7B and 8B of the size detecting levers 7 and 8, an operating portion is formed, the operating portion turning ON and OFF the corresponding button switches of the switch unit 10 according to the pivotal position when the sheet feeding cassette 12 is mounted in the copying machine main body 101.

An ON or OFF signal by the button switch of the switch unit 10 is sent to the control device 500 (FIG. 1), and the control device 500 discriminates the size of the sheet contained in the cassette body 12A based on the signal.

In this embodiment, the size detecting lever 7 is provided with two button switches of the switch unit 10 correspondingly to each other, and four types of combinations of ON and OFF by the two button switches exist. Therefore, the two button switches of the switch unit 10 output the ON or OFF signal to the control device 500 (FIG. 1) according to the pivotal position of the size detection lever 7. Similarly, the size detecting lever 8 is provided with two button switches of the switch unit 10 correspondingly to each other, and four combinations of ON and OFF by the two button switches exist. Therefore, the two button switches of the switch unit 10 output the ON or OFF signal to the control device 500 (FIG. 1) according to the pivotal position of the size detecting lever 8. Then, the control device 500 discriminates the size of the sheet by the combination of ON and OFF of the four button switches.

Incidentally, in this embodiment, the size detecting levers 7 and 8 are formed, with the lengths from the pivotal shaft 9 serving as the pivot supporting point to the distal ends 7A and 8A being different from each other.

Then, when the sheets of various widths which can be contained in the cassette body 12A are divided into the large size and the small size, the size detecting lever 8 is formed so as to have smaller length than the other size detecting lever 7 so as to detect the large size sheet. That is, when the small size sheet is contained in the cassette body 12A, as illustrated in FIG. 2, the size detecting lever 8 does not abut the side regulation plate 6, and pivots by being pressed by the side regulation plate 6 only when the large size sheet is contained in the cassette body 12A.

When the large size sheet is contained in the cassette body 12A, in the size detecting lever 7, the distance between the side regulation plate 6 and the pivotal supporting point of the size detecting lever 7 is small, and the pivotal amount (pivotal angle) of the size detecting lever 7 is small with respect to the moving amount of the side regulation plate 6. In contrast, when the large size sheet is contained in the cassette body 12A, because the size detecting lever 8 is smaller in length than the size detecting lever 7, the pivotal amount of the size detecting lever 8 is larger than that of the size detecting lever 7 with respect to the moving amount of the side regulation plate 6. Therefore, provision of the plurality of size detecting levers 7 and 8 having length different from each other enables detection of sheets of various sizes including the small size and the large size. As a result, detection accuracy of the various sizes of the sheet is improved.

Further, in this embodiment, the side regulation plate 6 is provided with a protrusion 61, which abuts the size detecting lever 7 and serves as an amplification portion for amplifying the pivotal amount of the size detecting lever 7 which pivots in association with the movement of the side regulation plate 6 to the regulation position. Note that "amplification" means that, though the pivotal angle of the size detecting lever 7 is reduced as the side regulation plate 6 moves so as to be closer to the pivot supporting point of the size detecting lever 7 even when the side regulation plate 6 moves by the same moving amount, the reduction rate of the pivotal angle is reduced. That is, "amplification" means to increase the pivotal amount of the size detecting lever 7 more than usual even when the side regulation plate 6 comes closer to the size detecting lever 7.

The protrusion 61 pivots, when the size detecting lever 7 abuts thereto, the size detecting lever 7 in the direction of separating away from the side regulation plate 6 according to the movement of the side regulation plate 6 toward the pivot supporting point of the size detecting lever 7, to thereby amplify the pivotal amount of the size detecting lever 7. On the other hand, the protrusion 61 pivots, when the size detecting lever 7 abuts thereto, the size detecting lever 7 in the direction of coming closer to the side regulation plate 6 according to the movement of the side regulation plate 6 separating away from the pivot supporting point of the size detecting lever 7, to thereby amplify the pivotal amount of the size detecting lever 7.

Further, the side regulation plate 6 is provided with a protrusion 62, which abuts the size detecting lever 8 and serves as the amplification portion configured to amplify the pivotal amount of the size detecting lever 8, which pivots in association with the movement of the side regulation plate 6 to the regulation position.

The protrusion 62 pivots, when the size detecting lever 8 abuts thereto, the size detecting lever 8 in the direction of separating away from the side regulation plate 6 in association with the movement of the side regulation plate 6 toward the pivot supporting point of the size detecting lever 8, to thereby amplify the pivotal amount of the size detecting lever 8. On the other hand, the protrusion 62 pivots, when the size detecting lever 8 abuts thereto, the size detecting lever 8 in the direction of coming closer to the side regulation plate 6 in association with the movement of the side regulation plate 6 separating away from the pivot supporting point of the size detecting lever 8, to thereby amplify the pivotal amount of the size detecting lever 8.

Figure 3A:
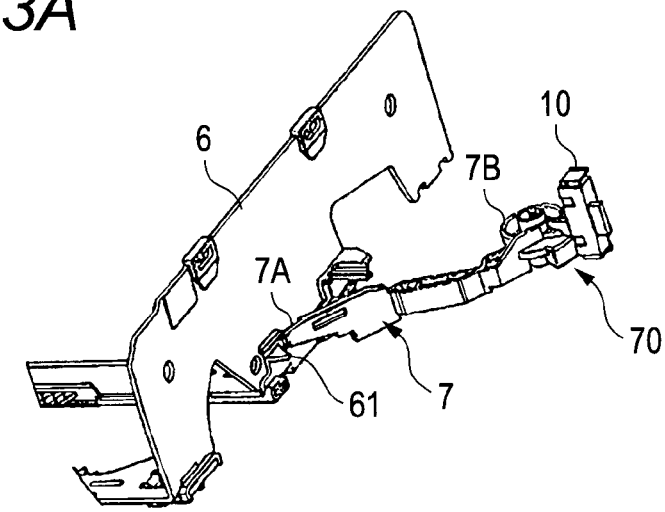
FIGS. 3A, 3B, and 3C are explanation diagrams illustrating states of a size detecting lever 7 in the case where a sheet having a width A categorized into a small size is contained in a cassette body.
Figure 3B:
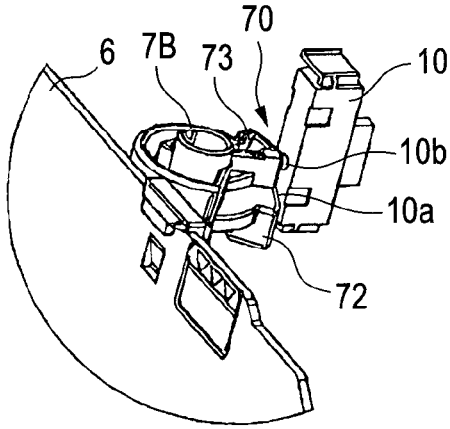
Figure 3C:
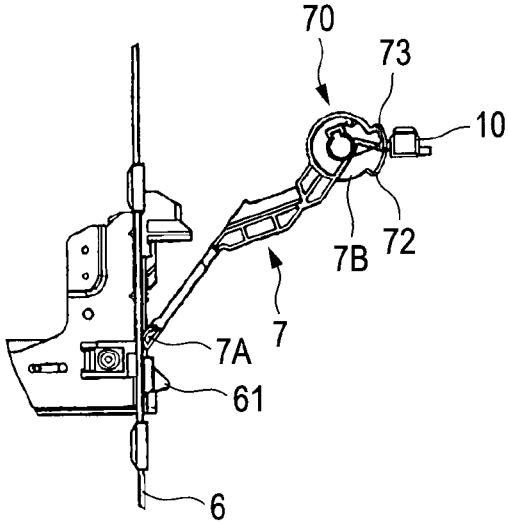

First, an operation of the size detecting lever 7 will be described. FIGS. 3A, 3B, and 3C are explanation diagrams illustrating states of the size detecting lever 7 in the case where the sheet having a width A categorized into the small size is contained in the cassette body 12A. FIG. 3A is a perspective view in the vicinity of the size detecting lever 7. FIG. 3B is a perspective view in the vicinity of the proximal end 7B of the size detecting lever 7. FIG. 3C is a plan view in the vicinity of the size detecting lever 7. Note that, in FIGS. 3A to 3C, the size detecting lever 8 and the button switches turned ON and OFF thereby are omitted.

In the case where the sheet having the width A categorized into the small size is contained in the cassette body 12A, as illustrated in FIGS. 3A and 3C, the distal end 7A of the size detecting lever 7 is not in sliding contact with the protrusion 61 but is in sliding contact with the side regulation plate 6. On the proximal end 7B of the size detecting lever 7, an operation portion 70 constituted by protrusions 72 and 73 is formed. As illustrated in FIG. 3B, the protrusions 72 and 73 of the size detecting lever 7 press button switches 10*a* and 10*b* of the switch unit 10. That is, the two button switches 10*a* and 10*b* are turned ON. As a result, the size detecting lever 7 detects that the sheet contained in the cassette body 12A has the width A.

Figure 4A:
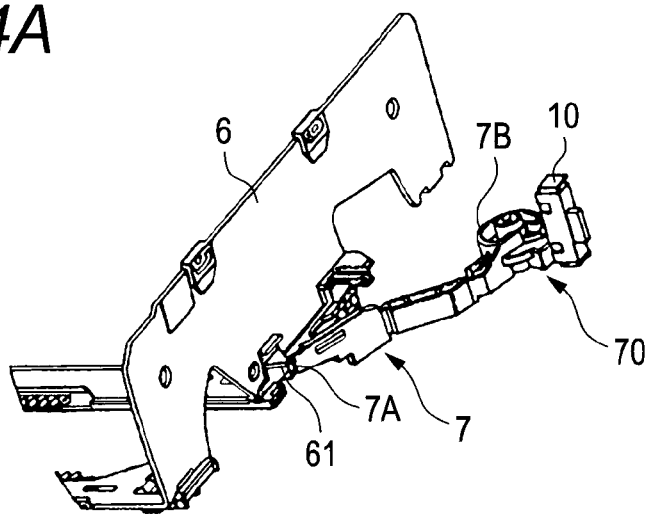
FIGS. 4A, 4B, and 4C are explanation diagrams illustrating states of the size detecting lever 7 in the case where a sheet having a width $A+2\times L_1$ categorized into the small size is contained in the cassette body.
Figure 4B:
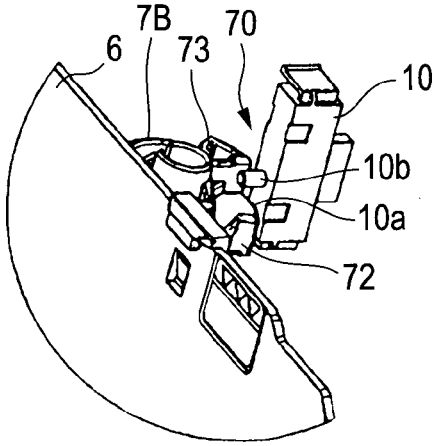
Figure 4C:
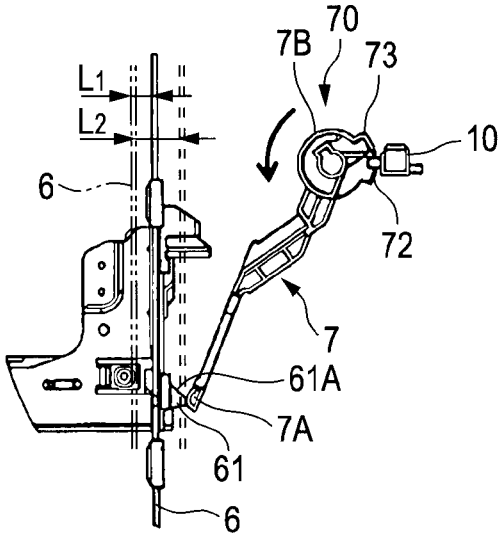

FIGS. 4A, 4B, and 4C are explanation diagrams illustrating the states of the size detecting lever 7 in the case where the sheet having a width $A+2\times L_1$ categorized into the small size is contained in the cassette body 12A. FIG. 4A is a perspective view in the vicinity of the size detecting lever 7. FIG. 4B is a perspective view in the vicinity of the proximal end 7B of the size detecting lever 7. FIG. 4C is a plan view in the vicinity of the size detecting lever 7. Note that, in FIGS. 4A to 4C, the size detecting lever 8 and the button switches turned ON and OFF thereby are omitted.

The sheet of the width $A+2\times L_1$ is larger in size by the width $2\times L_1$ than the sheet of the width A. Therefore, the side regulation plate 6 moves, with reference to the regulation position for regulating the side edges of the sheet of the width A, toward the size detecting lever 7 by the moving amount $L_1$.

In the case where the difference in size between the sheet of the width A and the sheet of the width $2\times L_1$ is slight, when the distal end of the size detecting lever is merely brought into sliding contact with the side regulation plate, the pivotal amount of the size detecting lever becomes small.

In contrast, as illustrated in FIG. 4A, the side regulation plate 6 is provided with the protrusion 61 in this embodiment, and the protrusion 61 amplifies the pivotal amount of the size detecting lever 7. The protrusion 61 is protrudingly provided on the side regulation plate 6 on the size detecting lever side.

Further, as illustrated in FIG. 4C, the protrusion 61 has a sliding contact portion 61*a* with which the distal end 7A of the size detecting lever 7 comes into sliding contact, and the protruding amount of the sliding contact portion 61*a* from the side plate portion 6 changes so as to amplify the pivotal amount of the size detecting lever 7. Specifically, the protruding amount changes so as to pivot the size detecting lever 7 in the direction of separating away from the side regulation plate 6 in association with the movement of the side regulation plate 6 in the direction of coming closer to the pivot supporting point of the size detecting lever 7.

In FIG. 4C, the chain double-dashed line indicates the side regulation plate 6 in the case of being moved to the regulation position for regulating the sheet having the size of width A. When the side regulation plate 6 is moved toward the size detecting lever 7 by the moving amount $L_1$ with reference to the regulation position for regulating the sheet having the size of the width A, the distal end 7A of the size detecting lever 7 comes into sliding contact with the sliding contact portion 61*a* of the protrusion 61, and moves along the sliding contact portion 61*a*. As a result, the size detecting lever 7 pivots by the same pivotal amount as that in the case of moving the side regulation plate by the moving amount $L_2$ larger than the moving amount $L_1$ to the position indicated by the broken line, the side regulation plate being not provided with the protrusion 61. That is, the pivotal amount of the size detecting lever 7 is amplified by the protrusion 61.

When the distal end 7A of the size detecting lever 7 thus comes into sliding contact with the protrusion to pivot the size detecting lever 7 in the direction indicated by the arrow of FIG. 4C, the protrusion 73 of the size detecting lever 7 is disengaged from the button switch 10*b* as illustrated in FIG. 4B, and pressing is cancelled. That is, the button switch 10*a* is turned ON, and the button switch 10*b* is turned OFF. As a result, it is detected that the sheet contained in the cassette body 12A has the size of the width $A+2\times L_1$.

As described above, even when the difference between the sheets of various types is small, it is possible to amplify the pivotal amount of the size detecting lever 7 so as to switch ON and OFF by the button switches 10*a* and 10*b* with use of the protrusion 61 according to the size of the sheet. Therefore, the detection accuracy of the sheets of various sizes is improved.

Figure 5A:
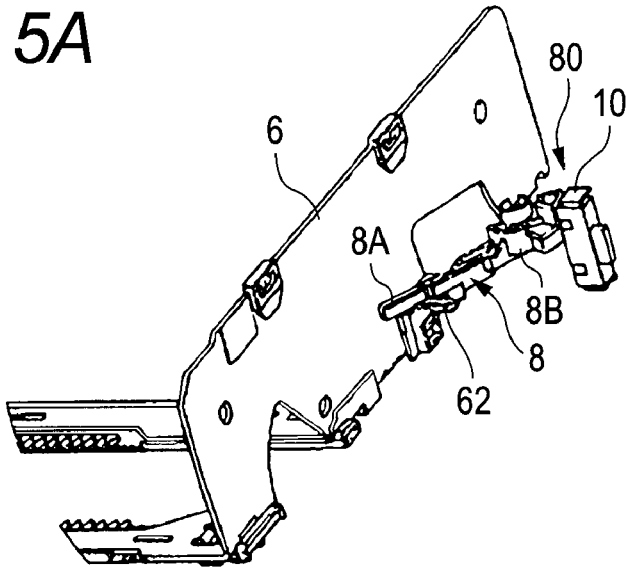
FIGS. 5A, 5B, and 5C are explanation diagrams illustrating states of a size detecting lever 8 in the case where a sheet having a width B categorized into a large size is contained in the cassette body.
Figure 5B:
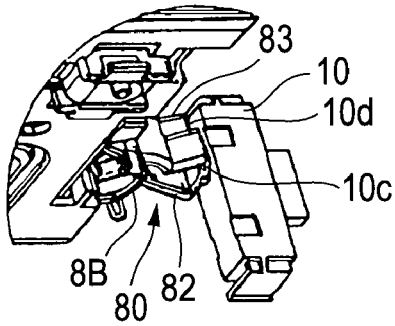
Figure 5C:
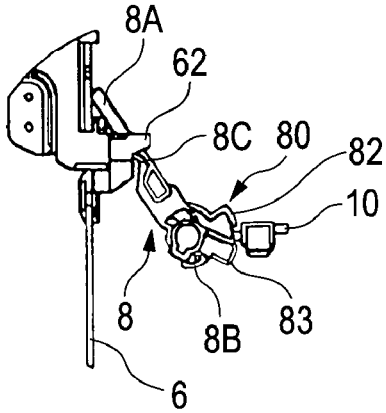

Next, an operation of the size detecting lever 8 will be described. FIGS. 5A, 5B, and 5C are explanation diagrams illustrating states of the size detecting lever 8 in the case where the sheet having a width B categorized into the large size is contained in the cassette body 12A. FIG. 5A is a perspective view in the vicinity of the size detecting lever 8. FIG. 5B is a perspective view in the vicinity of the proximal end 8B of the size detecting lever 8. FIG. 5C is a bottom view in the vicinity of the size detecting lever 8. Note that, in FIGS. 5A to 5C, the size detecting lever 7 and the button switches turned ON and OFF thereby are omitted.

In the case where the sheet having the width B categorized into the large size is contained in the cassette body 12A, as illustrated in FIGS. 5A and 5C, the distal end 8A of the size detecting lever 8 comes into sliding contact with the side regulation plate 6. On the proximal end 8B of the size detecting lever 8, an operation portion 80 constituted by protrusions 82 and 83 is formed. As illustrated in FIG. 5B, the protrusions 82 and 83 of the size detecting lever 8 press button switches 10*c* and 10*d* of the switch unit 10. That is, the two button switches 10*c* and 10*d* are turned ON. As a result, the size detecting lever 8 detects that the sheet contained in the cassette body 12A has the width B.

Figure 6A:
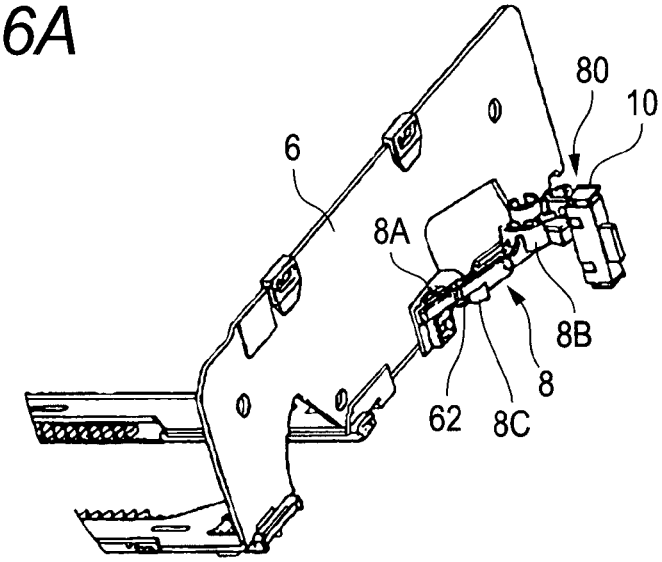
FIGS. 6A, 6B, and 6C are explanation diagrams illustrating states of the size detecting lever 8 in the case where a sheet having a width $B+2\times L_3$ categorized into the large size is contained in the cassette body.
Figure 6B:
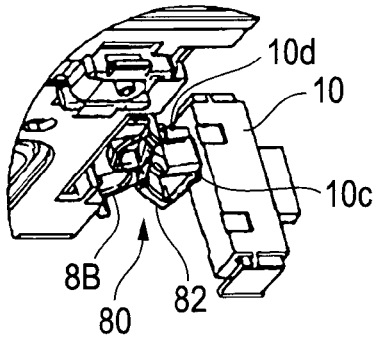
Figure 6C:
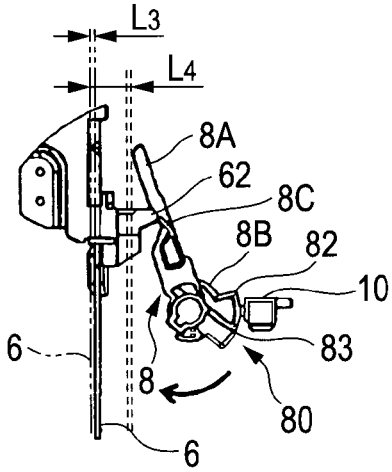

FIGS. 6A, 6B, and 6C are explanation diagrams illustrating the states of the size detecting lever 8 in the case where the sheet having a width $B+2\times L_3$ categorized into the large size is contained in the cassette body 12A. FIG. 6A is a perspective view in the vicinity of the size detecting lever 8. FIG. 6B is a perspective view in the vicinity of the proximal end 8B of the size detecting lever 8. FIG. 6C is a bottom view in the vicinity of the size detecting lever 8. Note that, in FIGS. 6A to 6C, the size detecting lever 8 and the button switches turned ON and OFF thereby are omitted.

The sheet of the width $B+2\times L_3$ is larger in size by the width $2\times L_3$ than the sheet of the width B. Therefore, the side regulation plate 6 moves, with reference to the regulation position for regulating the side edge of the sheet of the width B, toward the size detecting lever 8 by the moving amount $L_3$.

In the case where the difference in size between the sheet of the width B and the sheet of the width $B+2\times L_3$ is slight, when the distal end of the size detecting lever is merely brought into sliding contact with the side regulation plate, the pivotal amount of the size detecting lever becomes small.

In contrast, as illustrated in FIG. 6A, the side regulation plate 6 is provided with the protrusion 62 in this embodiment, and the protrusion 62 amplifies the pivotal amount of the size detecting lever 8. The protrusion 62 is protrudingly provided to the side regulation plate 6 on the size detecting lever side. Further, as illustrated in FIG. 6C, the protrusion 62 is protrudingly provided so as to abut a protruding portion 8C, which is a portion closer to the pivot supporting point compared with the distal end 8A of the size detecting lever 8.

In FIG. 6C, the chain double-dashed line indicates the side regulation plate 6 in the case of being moved to the regulation position for regulating the sheet having the size of width B. When the side regulation plate 6 is moved toward the size detecting lever 8 by the moving amount $L_3$ with reference to the regulation position for regulating the sheet having the size of width B, the protruding portion 8C of the size detecting lever 8 abuts the protrusion 62. Then, the distal end 8A is separated away from the side regulation plate 6. As a result, the size detecting lever 8 pivots by the same pivotal amount as that in the case where the side regulation plate is moved to the position indicated by the broken line by the moving mount $L_4$ larger than the moving amount $L_3$, the side regulation plate being not provided with the protrusion 62. That is, the pivotal amount of the size detecting lever 8 is amplified by the protrusion 62.

When the protruding portion 8C of the size detecting lever 8 thus comes into sliding contact with the protrusion 62 to pivot the size detecting lever 8 in the direction indicated by the arrow of FIG. 6C, the protrusion of the size detecting lever 8 is disengaged from the button switch 10*d* as illustrated in FIG. 6B, and pressing is cancelled. That is, the button switch 10*c* is turned ON, and the button switch 10*d* is turned OFF. As a result, it is detected that the sheet contained in the cassette body 12A has the size of the width $B+2\times L_3$.

As described above, even when the difference between the sheets of various types is small, it is possible to amplify the pivotal amount of the size detecting lever 8 so as to switch ON and OFF by the button switches 10*c* and 10*d* with use of the protrusion 62 according to the size of the sheet. Therefore, detection accuracy of the sheets of various sizes is improved.

In this manner, in association with the movement of the side regulation plate 6 to the regulation position according to various sizes, the two size detecting levers 7 and 8 selectively turn the button switches 10*a*, 10*b*, 10*c*, and 10*d* of the switch unit 100N and OFF. Then, the switch unit 10 outputs signals of different patterns to the control device 500 (FIG. 1). Further, the control device 500 discriminates the size of the sheet contained in the sheet feeding cassette 12.

As described above, provision of the protrusions and 62 for amplifying the pivotal amount of the size detecting levers 7 and 8 to the side regulation plate 6 allows the size detecting levers 7 and 8 to pivot to the appropriate pivotal position for turning the plurality of button switches 10*a* to 10*d* ON and OFF. Therefore, even when the difference in width size is small, accurate detection is enabled. As a result, it is possible to prevent erroneous detection of the size of the sheet. Further, because of elimination of the erroneous detection of the sheet size, it is possible to prevent sheet jamming, and hence operation of the copying machine 1 is stabilized.

Incidentally, in this embodiment, the protrusions 61 and 62 are structured so as to be detachably mountable to the side regulation plate 6. For example, the protrusions 61 and 62 are detachably fitted into holes (not shown) of the side regulation plate 6. As a result, the protrusions 61 and 62 are replaceable. Further, because the protrusions 61 and 62 are replaceable, it is possible to replace them according to the types (INCH type, AB type, and the like) of the sheet. Therefore, more accurate size detection is enabled.

Further, as another embodiment of the present invention, a description will be provided of the case where the protrusion abutting the size detecting lever 7 and the protrusion abutting the size detecting lever 8 are integrally formed.

Figure 7:
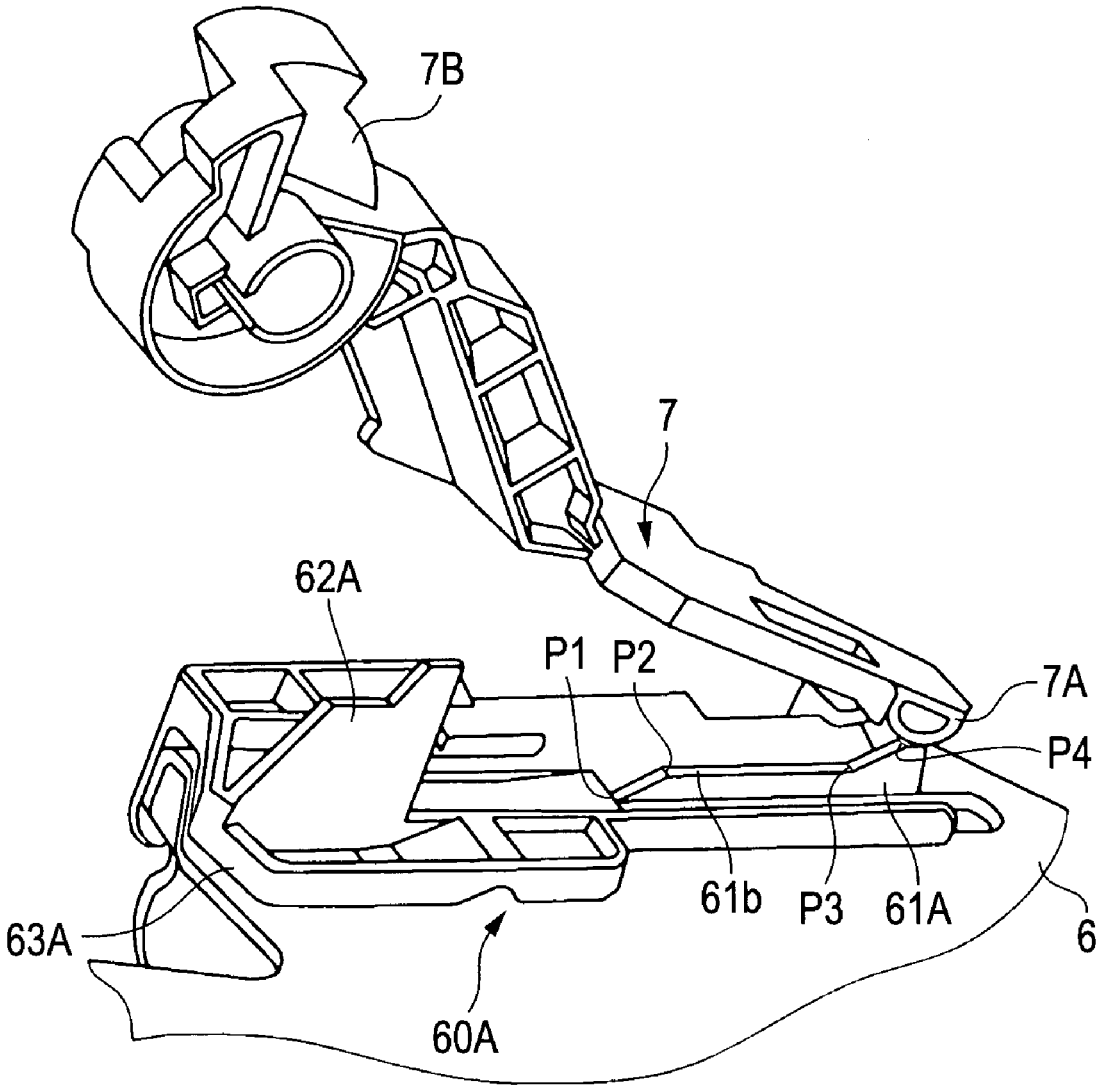
FIG. 7 is a perspective view illustrating a protrusion according to another embodiment of the present invention.

FIG. 7 is a perspective view illustrating a protrusion according to another embodiment of the present invention. Note that, in FIG. 7, the size detecting lever 8 is omitted.

To the side regulation plate 6, there are detachably mounted one piece 60A having a protrusion 61A and a protrusion 62A, the protrusion 61A serving as the amplification portion abutting the size detecting lever 7, the protrusion 62A serving as the amplification portion abutting the size detecting lever 8.

The piece 60A has a base 63A, and the protrusions 61A and 62A are formed on the base 63A.

In this embodiment, the size detecting levers 7 and 8 are brought into sliding contact with instead of the side regulation plate 6 but the base 63A of the piece 60A.

Further, when the size detecting lever 8 abuts the protrusion 62A, the protrusion 62A moves, similarly to the protrusion 62 of the above-mentioned embodiment, the distal end 8A of the size detecting lever 8 in the direction of separating away from the side regulation plate 6, to thereby amplify the pivotal amount of the size detecting lever 8.

In contrast, in the size detecting lever 7, the distal end 7A comes into sliding contact with the sliding contact portion 61*b* of the protrusion 61A, and the pivotal amount is amplified. However, the shape (protruding amount) of the sliding contact portion 61*b* thereof is different from that in the above-mentioned embodiment.

Figure 8:
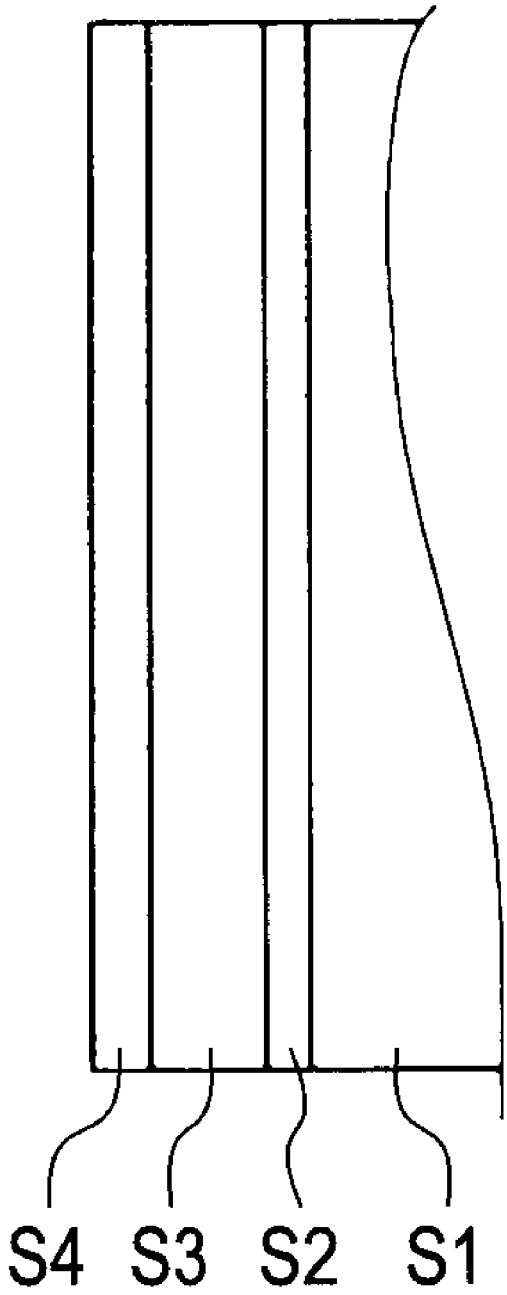
FIG. 8 is an explanation diagram illustrating ends of sheets of the various sizes which can be contained in the sheet feeding cassettes.

FIG. 8 is an explanation diagram illustrating edges of sheets of the various sizes, which sheets can be contained in the sheet feeding cassettes. FIG. 8 illustrates the state in which the sheets S1 to S4 are aligned with reference to the center. Among the sheets S1 to S4 of various sizes, sizes do not increase at a constant rate. That is, the difference in size between the sheet S1 and the sheet S2 and the difference between the sheet S3 and the sheet S4 are smaller than the difference between the sheet S2 and the sheet S3.

Hereinafter, a description will be provided with reference to FIGS. 7 and 8. When the sheet S1 of the smallest size is contained in the sheet feeding cassette, the distal end 7A of the size detecting lever 7 comes into sliding contact with a point P1 of the sliding contact portion 61*b*.

When the sheet S2 of the size slightly larger than that of the sheet S1 is contained in the sheet feeding cassette, the distal end 7A of the size detecting lever 7 comes into sliding contact with the point P2. At the point P2, the protruding amount of the sliding contact portion 61*b* is larger than that that at the point P1. As a result, the pivotal amount of the size detecting lever 7 is amplified.

When the sheet S3 of the size larger than that of the sheet S2 is contained in the sheet feeding cassette, the distal end 7A of the size detecting lever 7 comes into sliding contact with a point P3. At the point P3, the protruding amount of the sliding contact portion 61*b* is almost the same as that at the point P2. The difference in size between the sheet S2 and the sheet S3 is larger than that between the sheet S1 and the sheet S2, and variation of the protruding mount is substantially constant.

When the sheet S4 of the size slightly larger than that of the sheet S3 is contained in the sheet feeding cassette, the distal end 7A of the size detecting lever 7 comes into sliding contact with the point P4. At the point P4, the protruding amount of the sliding contact portion 61*b* is larger than that that at the point P3. As a result, the pivotal amount of the size detecting lever 7 is amplified.

That is, though the variation in size among the sheets S1 to S4 is not constant, the protruding amount of the sliding contact portion 61*b* is changed for amplifying the pivotal amount of the size detecting lever 7 so that the switch unit 10 (FIG. 1) is turned ON and OFF. The protruding amount of the sliding contact portion 61*b* is thus changed according to the sheet of the size which can be contained in the cassette body, and hence the detection accuracy of the sheet size is improved.

As described above, also in this embodiment, similarly to the above-mentioned embodiment, the detection accuracy of the sheet of various sizes is improved.

Note that, though the present invention has been described based on the above-mentioned embodiments, the present invention is not limited thereto.

In the above-mentioned embodiments, the description is provided of the case where the size detecting levers 7 and 8 are pivoted in association with the movement of the side regulation plate 6 as a regulation member. However, the size detecting levers may be pivoted in association with the movement of the side regulation plate 5 as the regulation member.

Further, in the above-mentioned embodiments, the description is provided of the case of detecting the size of the sheet in the width direction which is orthogonal to the sheet feeding direction. However, the present invention is not limited thereto. The size of the sheet in the length direction which is parallel to the sheet feeding direction may be detected. In this case, the size detecting lever may be disposed opposite to the trailing edge regulation plate, and the amplification portion may be provided to the trailing edge regulation plate serving as the regulation portion. Also with this structure, the detection accuracy of the size is improved similarly to the above-mentioned embodiments.

Further, though the description is provided of the above-mentioned embodiments in the case where the detection elements are the button switches 10*a* to 10*d* which are turned ON and OFF, the detection elements may be sensors which are turned ON and OFF.

Further, though the description is provided of the above-mentioned embodiments in the case where the size detecting levers 7 and 8 are provided in the cassette body 12A, the size detecting levers 7 and 8 may be provided in the apparatus main body. In such case, it is possible to adopt a structure in which the size detecting levers pivot by being pressed by the regulation plate when the cassette body is mounted in the apparatus main body.

Further, though the description is provided of the above-mentioned embodiments in the case where the switch unit 10 having the plurality of detection elements is provided in the apparatus main body, the switch unit 10 may be provided in the cassette body. In such case, the switch unit may send a signal to the control device by coming into contact with terminals (not shown) provided in the apparatus main body when the sheet feeding cassette is mounted in the apparatus main body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-018819, filed Jan. 29, 2009, which is hereby incorporated by reference herein in its entirety.

What is claimed is:

1. A sheet feeding apparatus, comprising:

a sheet feeding cassette, which is mounted in an apparatus main body, and has a cassette body configured to contain a sheet and a side regulation member which is movably disposed in the cassette body and is configured to contact and regulate an edge of the sheet with a front regulation surface;

a sheet feeding portion configured to feed the sheet contained in the cassette body; and a size detecting portion, disposed on a side opposite to a side on which the sheet of the sheet feeding cassette is contained, configured to detect a size of the sheet contained in the cassette body, wherein the size detecting portion comprises:

a size detecting lever, of which a distal end is in sliding contact with a back surface, parallel to the front regulation surface, of the side regulation member and a proximal end is supported by a pivotal shaft, the size detecting lever configured to pivot in association with a movement of the side regulation member to a regulation position according to the size of the sheet;

a plurality of detection elements turned ON and OFF according to a pivotal position of the proximal end of the size detecting lever; and a protrusion which is protrudingly provided on the back surface of the side regulation member, the distal end of the size detecting lever being in sliding contact with the protrusion so that the size detecting lever is pivoted in a direction of separating away from the side regulation member according to a movement of the side regulation member toward the size detecting portion.

2. A sheet feeding apparatus according to claim 1, wherein the protrusion includes a plurality of sliding contact portions of different protruding amounts protruded from the side regulation member.

3. A sheet feeding apparatus according to claim 1, wherein the protrusion is protrudingly provided so as to abut a portion closer to the pivot point than the distal end of the size detecting lever.

4. A sheet feeding apparatus according to claim 1, wherein the protrusion is detachably provided on the side regulation member.

5. A sheet feeding apparatus according to claim 1, wherein a plurality of size detecting levers are provided on the pivotal shaft and each of the plurality of size detecting levers has a different length from the pivotal shaft to the distal end thereof and a long lever of the size detecting levers and a short lever of the size detecting levers contact the side regulation member in order.

6. An image forming apparatus, comprising:

a sheet feeding apparatus configured to feed a sheet; and an image forming portion configured to form an image on the sheet sent from the sheet feeding apparatus, the sheet feeding apparatus comprising:

a sheet feeding cassette, which is mounted in an apparatus main body, and has a cassette body configured to contain the sheet and a side regulation member which is movably disposed in the cassette body and is configured to contact and regulate an edge of the sheet with a front regulation surface;

a sheet feeding portion configured to feed the sheet contained in the cassette body; and a size detecting portion, disposed on a side opposite to a side on which the sheet of the sheet feeding cassette is contained, configured to detect a size of the sheet contained in the cassette body, wherein the size detecting portion comprises:

a size detecting lever, of which a distal end is in sliding contact with a back surface, parallel to the front regulation surface, of the side regulation member and a proximal end is supported by a pivotal shaft, the size detecting lever configured to pivot in association with a movement of the side regulation member to a regulation position according to the size of the sheet;

a plurality of detection elements turned ON and OFF according to a pivotal position of the proximal end of the size detecting lever; and a protrusion which is protrudingly provided on the back surface of the side regulation member, the distal end of the size detecting lever being in sliding contact with the protrusion so that the size detecting lever is pivoted in a direction of separating away from the side regulation member according to a movement of the side regulation member toward the size detecting portion.

7. An image forming apparatus according to claim 6, wherein the protrusion includes a plurality of sliding contact portions of the different protruding amounts protruded from the side regulation member.

8. An image forming apparatus according to claim 6, wherein the protrusion is protrudingly provided so as to abut a portion closer to the pivot point than the distal end of the size detecting lever.

9. An image forming apparatus according to claim 6, wherein the protrusion is detachably provided on the side regulation member.

10. An image forming apparatus according to claim 6, wherein a plurality of size detecting levers are provided on the pivotal shaft and each of the plurality of size detecting levers has a different length from the pivotal shaft to the distal end thereof and a long lever of the size detecting levers and a short lever of the size detecting levers contact the side regulation member in order.

* * * * *